US006265647B1

(12) United States Patent
Tamaki et al.

(10) Patent No.: US 6,265,647 B1
(45) Date of Patent: Jul. 24, 2001

(54) KEYBOARD MUSICAL INSTRUMENT HAVING HAMMER STOPPER CHANGED BETWEEN FREE POSITION AND BLOCKING POSITION THROUGH TURN ON HORIZONTAL PLANE

(75) Inventors: Takashi Tamaki; Katsuo Itou, both of Shizuoka (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/489,301

(22) Filed: Jan. 21, 2000

(30) Foreign Application Priority Data

Jan. 22, 1999 (JP) ..... 11-014490

(51) Int. Cl.[7] ..... G10C 3/00
(52) U.S. Cl. ..... 84/216; 84/220
(58) Field of Search ..... 84/170, 171, 216, 84/220, 221, 236

(56) References Cited

U.S. PATENT DOCUMENTS 5,565,636 10/1996 Sugiyama .
5,583,306 * 12/1996 Hayashida et al. ..... 84/171
5,600,077 2/1997 Honda .
5,616,880 * 4/1997 Hayashida et al. ..... 84/171 X
5,741,995 * 4/1998 Kawamura et al. ..... 84/171 X
5,949,013 9/1999 Satoshi .

FOREIGN PATENT DOCUMENTS 7-230279 8/1995 (JP) .
8-63149 3/1996 (JP) .
10-149154 6/1998 (JP) .

* cited by examiner

*Primary Examiner*—Jeffrey Donels
(74) *Attorney, Agent, or Firm*—Morrison & Foerster

(57) ABSTRACT

A keyboard musical instrument is a combination of an acoustic piano, a silent system and an electronic sound generating system, and the silent system includes a change-over mechanism and a shank stopper connected to the change-over mechanism so as to be changed between a free position and a blocking position, wherein a change-over mechanism gives rise to a rotation of the shank stopper around vertical axes spaced apart from each other on a horizontal virtual plane so that the hammer stopper is free from a twist.

11 Claims, 9 Drawing Sheets

KEYBOARD MUSICAL INSTRUMENT HAVING HAMMER STOPPER CHANGED BETWEEN FREE POSITION AND BLOCKING POSITION THROUGH TURN ON HORIZONTAL PLANE

FIELD OF THE INVENTION

This invention relates to a keyboard musical instrument and, more particularly, to a keyboard musical instrument equipped with a hammer stopper.

DESCRIPTION OF THE RELATED ART

The keyboard musical instrument is broken down into an acoustic piano, an electronic sound generating system and a silent system. The silent system has the hammer stopper, which is changed between a free position and a blocking position. While the hammer stopper is staying in the free position, the hammers selectively strike the sets of strings without any interference, and the strings vibrate for generating acoustic sounds. When the hammer stopper is changed to the blocking position, the hammer stopper is positioned on the trajectories of the hammers. A depressed key actuates the associated key action mechanism, and the hammer is driven for free rotation by the key action mechanism. Although the hammer is moved along the trajectory, the hammer rebounds on the hammer stopper without striking the set of strings. For this reason, any acoustic sound is generated. However, the electronic sound generating system detects the key motion, and a headphone generates an electronic sound instead of the acoustic sound. The electronic sound generating system can records a performance on the keyboard in the form of digital data codes.

The hammer stopper laterally extends in the space between the hammer shanks and the sets of strings, and the hammer shanks rebound on the hammer stopper. For this reason, this kind of hammer stopper is called as "shank stopper". A link mechanism is connected to the shank stopper, and a wire interconnects the link mechanism and a knob. A player manipulates the knob so as to change the shank stopper between the free position and the blocking position.

The prior art link mechanism has two parallel links. Both parallel links are spaced from each other, and are turnably connected to a stationary member. The shank stopper is attached to the other ends of the parallel links, and the links, the stationary member and the shank stopper form in combination a parallel crank. The wire is connected to one of the links, and gives rise to a parallel motion. The parallel crank changes the distance between the shank stopper and the stationary member through the parallel motion. A position close to the stationary member and another position spaced from the stationary member are corresponding to the two positions of the shank stopper. The parallel links vertically project from the stationary member, and the shank stopper is changed in the vertical direction.

The first problem inherent in the prior art silent system is torsion of the shank stopper. This is because of the fact that the shank stopper is shared between all the hammer shanks. A standard acoustic piano has eighty-eight keys and, accordingly, eighty-eight hammers. The eighty-eight hammers are laterally arranged, and the distance between the leftmost hammer and the rightmost hammer is long. The shank stopper is opposed to the hammer shanks of all the hammers, and is also long. As described hereinbefore, the wire is connected to one of the links, and the motion of the link is transferred through the shank stopper to the other link. In this situation, when the wire is pulled, the link connected thereto gives rise to the parallel motion. However, the shank stopper is not rigid, but is deformable. The turning motion of the link is causative of the torsion, and the other end portion of the shank stopper does not enter the blocking position. This results in undesirable acoustic sounds. If plural wires are connected to the shank stopper at intervals, the shank stopper may be free from the torsion. However, the silent system is complicated, and increases the production cost of the prior art keyboard musical instrument.

The unintentional change to the free position is the second problem inherent in the prior art silent system. The second problem is also derived from the long shank stopper. The hammer shanks rebound on the shank stopper. The impact is strong, and causes the shank stopper to be unintentionally changed to the free position. This results in undesirable acoustic sounds. Thus, the prior art silent system is not reliable.

A spring is used in another prior art silent system so as to move the hammer stopper in the vertical direction, and yet another shank stopper is changed between the free position and the blocking position through bi-directional rotation. However, the first problem and/or the second problem is encountered in those prior art silent systems.

SUMMARY OF THE INVENTION

It is therefore an important object of the present invention to provide a keyboard musical instrument, a silent system of which is simple and reliable.

To accomplish the object, the present invention proposes to move a hammer stopper between a free position and a blocking position through a horizontal motion.

In accordance with one aspect of the present invention, there is provided a keyboard musical instrument having a lateral direction and a fore-and-aft direction perpendicular to the lateral direction comprising a keyboard having plural keys arranged in the lateral direction and assigned notes of a scale, respectively, plural music strings for generating acoustic tones of the notes, respectively, plural hammers respectively linked with the plural keys for striking the plural music strings, respectively and a silent system including a hammer stopper selectively entering a free position where the plural hammers are allowed to strike the associated music strings and a blocking position where the hammers rebound thereon before striking the associated music strings and a change-over means connected to the hammer stopper so as to change the hammer stopper between the free position and the blocking position, and the hammer stopper includes two members spaced apart from one another in the lateral direction and respectively having vertical axes of rotation at first end portions thereof, absorbing means where the hammers rebound. and a movable member supporting the absorbing means and connected to second end portions of the two members spaced from the first end portions so that the change-over means gives rise to a rotation of the movable member around the axes of rotation.

BRIEF DESCRIPTION OF THE DRAWINGS

The features and advantages of the keyboard musical instrument will be more clearly understood from the following description taken in conjunction with the accompanying drawings in which.

DESCRIPTION OF THE PREFERRED EMBODIMENT

Figure 1:
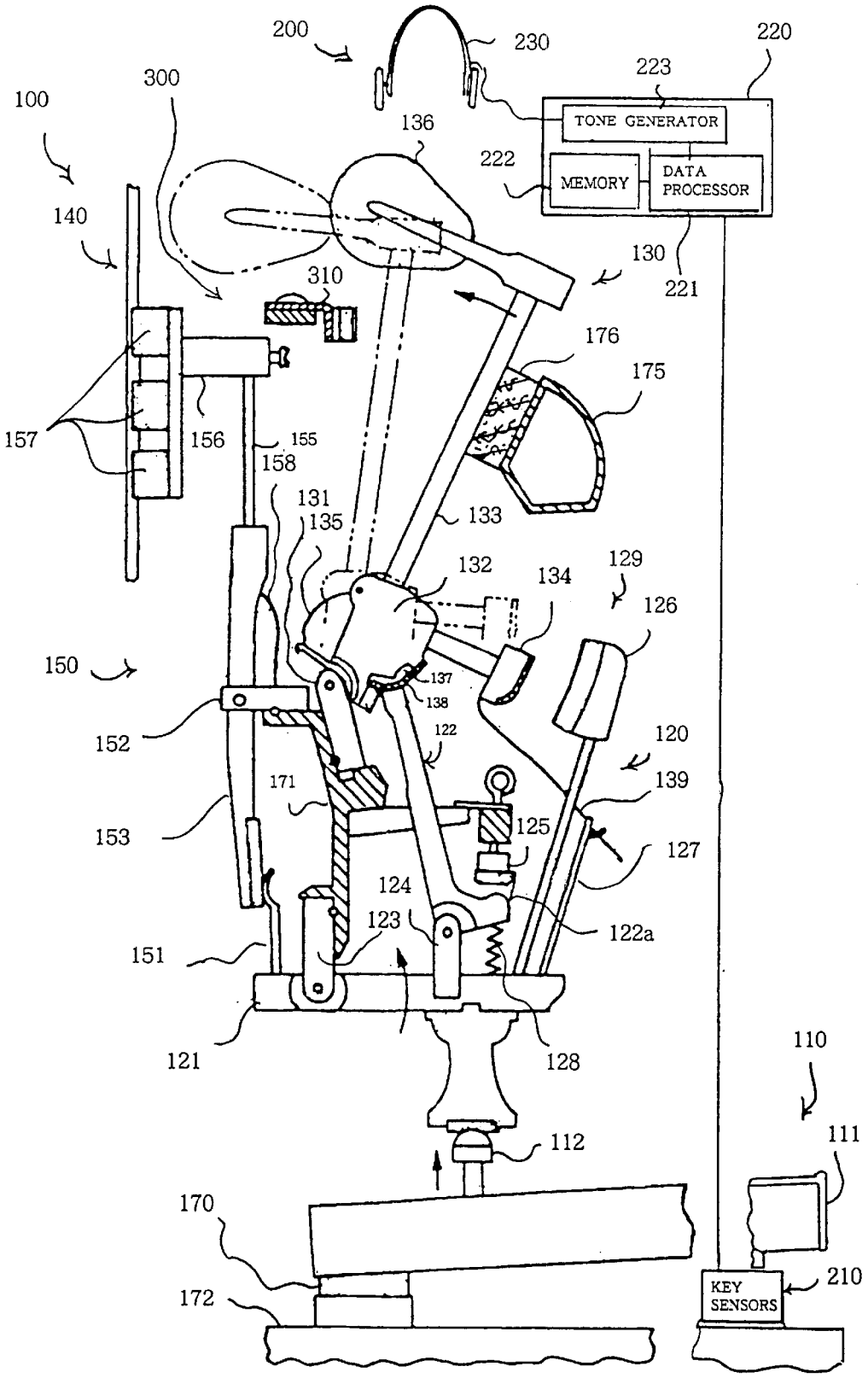
FIG. 1 is a side view showing essential parts of a keyboard musical instrument according to the present invention.

Referring to FIG. 1 of the drawings, a keyboard musical instrument embodying the present invention largely comprises an acoustic piano 100, an electronic sound generating system 200 and a silent system 300. The acoustic piano 100 is a standard upright piano, and includes a keyboard 110, key action mechanisms 120, hammer assemblies 130, sets of strings 140, damper mechanisms 150 and pedal mechanisms (not shown). The keyboard 110 are linked with the key action mechanisms 120 and the damper mechanisms 150. The keyboard 110 selectively actuates the key action mechanisms 120. The hammer assemblies 130 are respectively driven for rotation by the associated key action mechanisms 120, and strike the associated sets of strings 140. The damper mechanisms 150 leave the associated sets of strings 140, and allow the strings to vibrate for generating acoustic sounds. Thereafter, the damper mechanisms 150 are brought into contact with the associated sets of strings, and damp the vibrations. The acoustic piano 100 is hereinlater described in detail.

The electronic sound generating system 200 includes key sensors 210, a controller 220 and a headphone 230. The key sensors 210 are provided under the keyboard 110, and supply key position signals representative of current key positions to the controller 220. A data processor 221, a memory 222 and a tone generator 223 are incorporated in the controller 220. Computer programs are stored in the memory 222, and run on the data processor 221. The memory 222 further offers a data storage to the data processor 221. The data processor 221 periodically checks the key position signals for current key status, and produces music data codes representative of the key motions. The music data codes are supplied to the tone generator 223, and the tone generator 223 forms an audio signal from the music data codes. The audio signal is supplied to the headphone 230, and electronic sounds are produced in the headphone 230.

Figure 5:
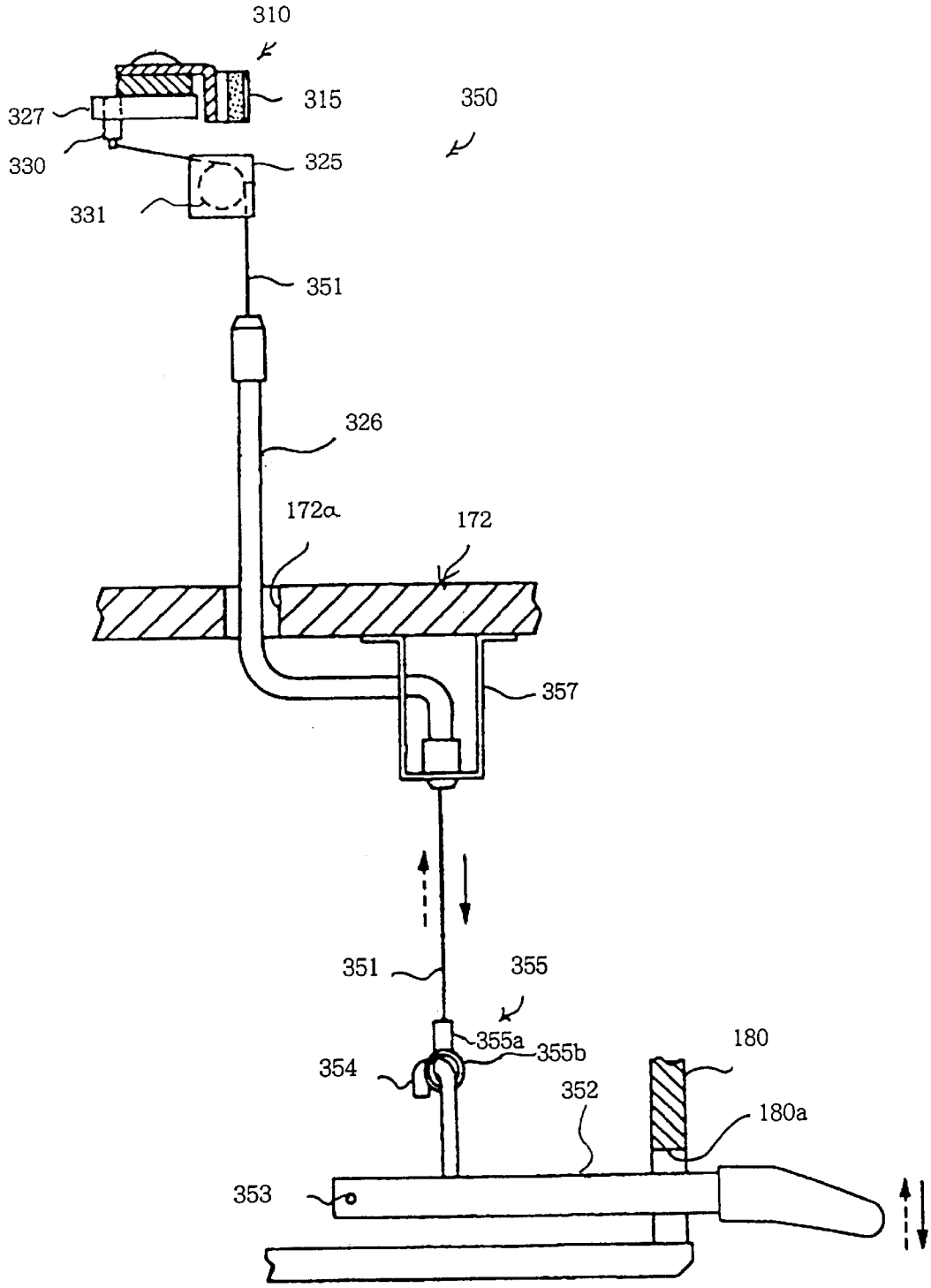
FIG. 5 is a side view showing a change-over mechanism connected to the shank stopper.

The silent system 300 includes a shank stopper 310 and a change-over. mechanism 350 (see FIG. 5). A player manipulates the change-over mechanism 350 so as to change the shank stopper 310 between a free position and a blocking position. While the shank stopper 310 is staying in the free position, the hammer assemblies 130 are allowed to strike the associated sets of strings 140 without any interference. However, when the shank stopper 310 is changed to the blocking position, the shank stopper 310 is positioned on the trajectories of the hammer assemblies 130. In this situation, the hammer assemblies 130 rebound on the shank stopper 310 before striking the strings 140, and the acoustic sound is not generated.

The acoustic piano 100 is hereinbelow detailed. Eighty-eight keys 111 are laid on the pattern of a well-known piano keyboard. Capstan buttons 112 project from the rear end portions of the keys 111, respectively. Though not shown in FIG. 1, balance pins offer centers of rotation around a balance rail to the keys 111. While any force is not exerted on the front ends of the keys 111, the keys are staying in respective rest positions. When the force is exerted, the key 111 is moved toward an end position.

The key action mechanisms 120 are similar in structure to one another, and one of the key action mechanisms 120 is described hereinbelow. The key action mechanism 120 includes a whippen 121, a jack 122, a whippen flange 123, a jack flange 124, a regulating button 125, a back check assembly 126 and a bridle wire 127. A center rail 171 laterally extend over the rear end portions of the keys 111, and is supported by action brackets (not shown) on a key bed 172. The whippen 121 is rotatably connected through the whippen flange 123 to the rear surface of the center rail 171. The jack flange 124, the back check assembly 126 and the bridle wire 127 project from the upper surface of the whippen 121. The jack 122 is rotatably supported by the jack flange 124, and a jack spring 128 urges the jack in the counter clockwise direction. The regulating button 125 is also supported by the center rail 171, and is opposed to the toe 122*a* of the jack 122. The distance between the regulating button 125 and the toe 122*a* is regulable. The whippen 121, the whippen flange 123, the jack flange 124, the jack 122, the jack spring 128, the back check assembly 126 and the bridle wire 127 as a whole constitute a whippen assembly 129. While the rear end portion of the associated key 111 is resting on a back rail cloth 170, the self weight keeps the whippen assembly 129 at a home position.

While a player is depressing the associated key 111, the capstan button 112 pushes the whippen assembly 121, and gives rise to a rotation of the whippen assembly 121 around the whippen flange 123 in the counter clockwise direction. The jack 122 also turns round the whippen flange 123, and gives rise to a rotation of the hammer assembly 130 in the counter clockwise direction. However, the jack 122 does not turn around the jack flange 124. When the toe 122*a* is brought into contact with the regulating button 125, the jack 122 quickly turns around the jack flange 124, and escapes from the hammer assembly 130. Then, the hammer assembly starts the free rotation toward the associated set of strings 140.

The hammer assembly 130 includes a butt flange 131, a butt 132, a hammer shank 133 and a catcher 134. The butt flange 131 is attached to the front surface of the center rail 171, and the butt 132 is rotatably connected to the butt flange 131. The hammer shank 133 upwardly projects from the butt 132, and the catcher 134 forwardly projects from the butt 132. The catcher 134 is opposed to the back check assembly 126.

The hammer assembly 130 further includes a butt spring 135, a hammer 136, a butt under felt 137, a butt under skin 138 and a bridle tape 139. The butt spring 135 is inserted between the butt flange 131 and the butt 132, and urges the butt 132 in the clockwise direction. The butt under felt 137 and the butt under skin 138 are laminated on a lower surface of the but 132, and the butt under skin 138 is contacted with the top surface of the jack 122. The hammer 136 is attached to the hammer shank 133, and is opposed to the associated set of strings 140. The bridle tape 139 is connected at one end thereof the catcher 134 and the other end thereof to the bridge wire 127. While the whippen assembly 129 is returning to the home position, the bridge tape 139 forces the hammer assembly 130 to follow the whippen assembly 129, and prevents the set of strings 140 from undesirable double strike.

A hammer rail 175 laterally extends over the key action mechanisms 120, and a hammer rail cloth 176 is adhered to the rear surface of the hammer rail 175. While the rear end portion of the associated key 111 is resting on a back rail cloth 170, the butt spring 135 presses the hammer shank 133 against the hammer rail cloth 176, and the butt under skin 138 is in contact with the top surface of the jack 122. The hammer 136 is spaced from the associated set of strings 140, and the catcher 134 is also spaced from the back check assembly 126. Thus, the hammer assembly 130 is resting at the home position thereof.

When the tow 122*a* is brought into contact with the regulating button 125, the jack 122 quickly turns around the jack flange 124, and escapes from the butt under skin 138. Since the jack 122 gives friction to the butt under skin 130 during the escape, the hammer assembly 130 starts the free rotation around the butt flange 131 against the elastic force of the butt string 135. If the shank stopper 310 is out of the trajectory of the hammer shank 133, the hammer strikes the set of strings 140, and rebounds. The player releases the depressed key 111, and the key 111 returns toward the rest position. The capstan button 112 is downwardly moved, and the self-weight causes the whippen assembly 129 to turn around the whippen flange 123 in the clockwise direction. The jack spring urges the jack 122 in the counter clockwise direction, and the jack returns to its home position. The bridge tape 139 forces the hammer assembly 130 to follow the whippen assembly 130, and the butt under skin 130 lands on the top surface of the jack 122. The hammer shank 133 reaches the hammer rail cloth 176, and the hammer assembly 130 returns to the home position.

The damper mechanisms 150 are also similar in structure to one another, and only one of the damper mechanism 150 is described hereinbelow. The damper mechanism 150 includes a damper spoon 151, a damper flange 152, a damper lever 153, a damper wire 155, a damper wood 156, damper felts 157 and a damper spring 158. The damper spoon 151 projects from the upper surface of the rear end portion of the whippen 121, and the damper flange 152 is attached to the upper surface of the center rail 171. The damper lever 153 is rotatably connected to the damper flange 152. The damper wire 155 projects from the damper lever 153, and the damper wood 156 is fixed to the leading end of the damper wire 155. The damper felts are adhered to the rear surface of the damper wood 156. The damper spring 158 is inserted between the damper flange 152 and the damper lever 153, and urges the damper lever 153 in the counter clockwise direction. As a result, the lower portion of the damper lever 153 is held in contact with the damper spoon 151, and the damper felts 157 are pressed against the set of strings 140.

While the rear end portion of the associated key 111 is resting on the back rail cloth 170, the damper spring 158 presses the damper felts 156 against the set of strings 140. The set of strings 140 is not allowed to vibrate. While the player is depressing the key 111, the capstan button 112 rotates the whippen 121 in the counter clockwise direction as described hereinbefore. The rotation of the whippen 121 gives rise to inclination of the damper spoon 151. The damper spoon 151 pushes the lower portion of the damper lever 153 in the clockwise direction against the elastic force of the damper spring 158, and, accordingly, the rotation of the damper lever 153 spaces the damper felts 157 from the set of strings 140. Thus, the set of strings 140 is allowed to vibrate. When the hammer 136 strikes the set of strings 140, the strings 140 vibrate, and generate an acoustic sound.

When the player releases the depressed key 111, the whippen assembly 129 starts to turn around the whippen flange 123 in the clockwise direction. This results in that the damper spoon 151 rises again. The damper spring 158 urges the damper lever 158 to turn in the counter clockwise direction, and the damper felts 157 are brought into contact with the set of strings 140. The damper felts 157 damp the vibrations.

Subsequently, description is made on the silent system 300 with reference to FIGS. 2, 3, 4 and 5. The silent system 300 is broken down into the shank stopper 310 and the change-over mechanism 350. The shank stopper 310 includes a rail base 311, the stopper rail segments 312/313/314 and absorbers 315/316/317. The length of the rail base 311 is greater than the width of the array of the hammer assemblies 130. The rail base 311 has a sloop 311*a* between a short portion 311*b* and a long portion 311*c*.

The stopper rail segments 312/313/314 have an L-letter cross section, and bolt holes 318 are formed in the upper portions of the stopper rail segments 312/313/314. The bolt holes 318 are elongated, and are open to the rear surfaces of the stopper rail segments 312/313/314 as will be better seen in FIGS. 3 and 4. Bolts 319 respectively pass the bolt holes 318, and are screwed into the short/long end portions 311*b*/311*c*. Thus, the stopper rail segment 312 is bolted to the upper surface of the short portion 311*b*, and the other stopper rail segments 313/314 are bolted to the upper surface of the long portion 311*c*. The stopper rail segment 313 is spaced from the stopper rail segment 314.

The elongated bolt holes 318 make the stopper rail segments 312/313/314 projectable and retractable with respect to the rail base 311. Even if any one of the absorbers 315/316/317 is not appropriately positioned at the blocking position, the manufacturer independently regulates the absorber 315/316/317 without an influence on the positions of the other absorbers. Thus, the absorbers 315/316/317 respectively enter the optimum blocking positions. This feature is desirable, because the manufacturer prepares all the absorbers 315/316/317 in a predetermined thickness for the fabrication and the maintenance in future. This results in reduction in cost. The 315/316/317 are to be positioned between the escaping points and the striking points, and the gap between the escaping points and the striking points is neither wide nor constant. If the stopper rail segments 312/313/314 are fixed to the rail base 311, the manufacturer feels the positioning work difficult, and widens the gap by changing the regulating buttons 125 from the optimum positions, However, the change from the optimum positions damages the key- touch. In this instance; the stopper rail segments 312/313/314 are independently projectable and retractable. The manufacturer positions the absorbers 315/316/317 at the optimum positions without changing the regulating buttons 125, and the key touch is never damaged. Thus, it is possible to minimize the variation of the gap between the hammer 136 and the strings 140 when the key 111 is depressed at an extremely low speed.

The absorbers 315/316/317 are attached to the front surfaces of the stopper rail segments 312/313/314, respectively, and a lamination of felt sheet and an artificial leather sheet is, by way of example, used as each of the absorbers 315/316/317. A sheet of urethane foam is available for the absorber 315/316/317.

The absorbers 315, 316 and 317 are assigned to the hammer assemblies 130 for a lower-pitched part, the hammer assemblies 130 for a middle-pitched part and the hammer assemblies 130 for a higher-pitched part, respectively. The sets of strings 140 are arranged in such a manner that the strings 140 for the lower-pitched part cross the strings 140 for the middle-pitched part and the strings 140 for the higher-pitched part. Accordingly, the hammer heads 136 strike the associated sets of strings 140 at the points different in height. Moreover, several hammers 136 and the associated dampers 156/157 for the middle-pitched part closer to the lower-pitched part are higher than the other hammers 136 and the associated dampers 156/157 for the middle-pitched part. In order to regulate the absorbers 316/316/317 to appropriate height, the rail base 311 includes the sloop 311*a,* and the long portion 311*c* is partially bent around 311*d* for the several hammers 136. Thus, the base rail 311 moves the absorbers 315/316/317 to the optimum positions in the blocking position, and the shank stopper 310 does not disturb the hammers 136 and the dampers 156/157.

Figure 3:
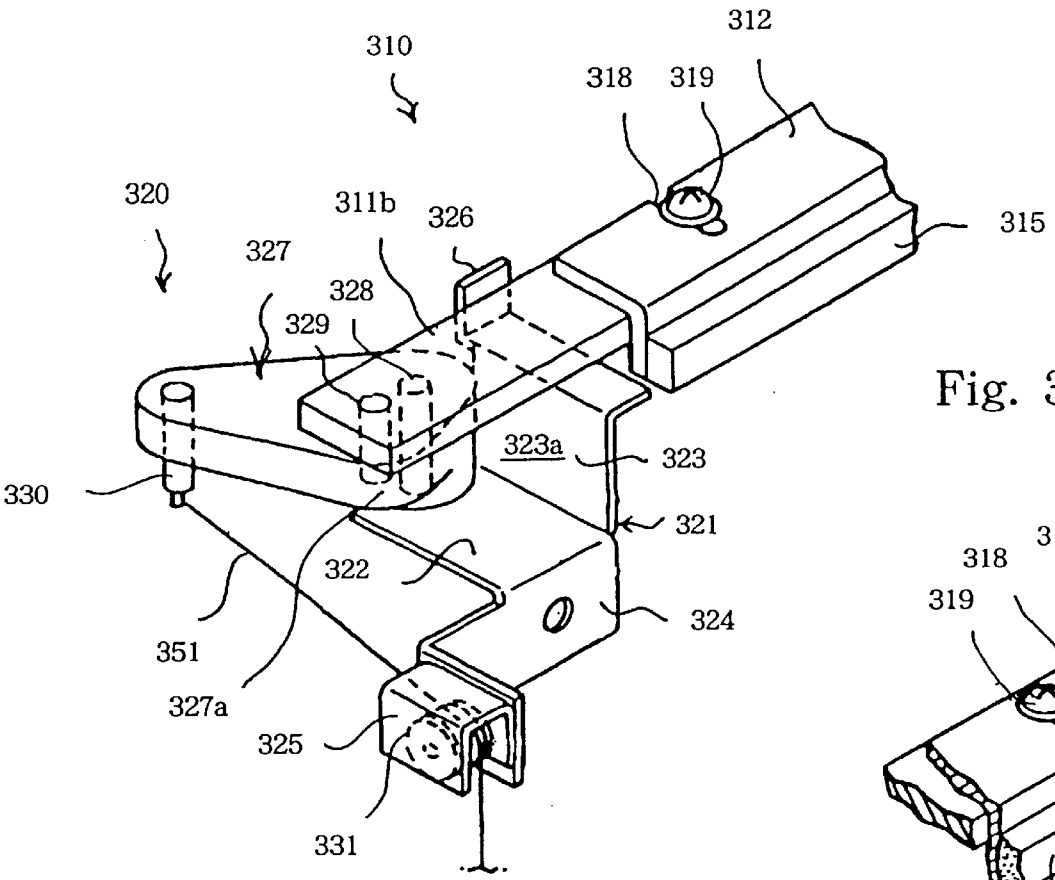
FIG. 3 is a perspective view showing one end portion of the shank stopper.
Figure 4:
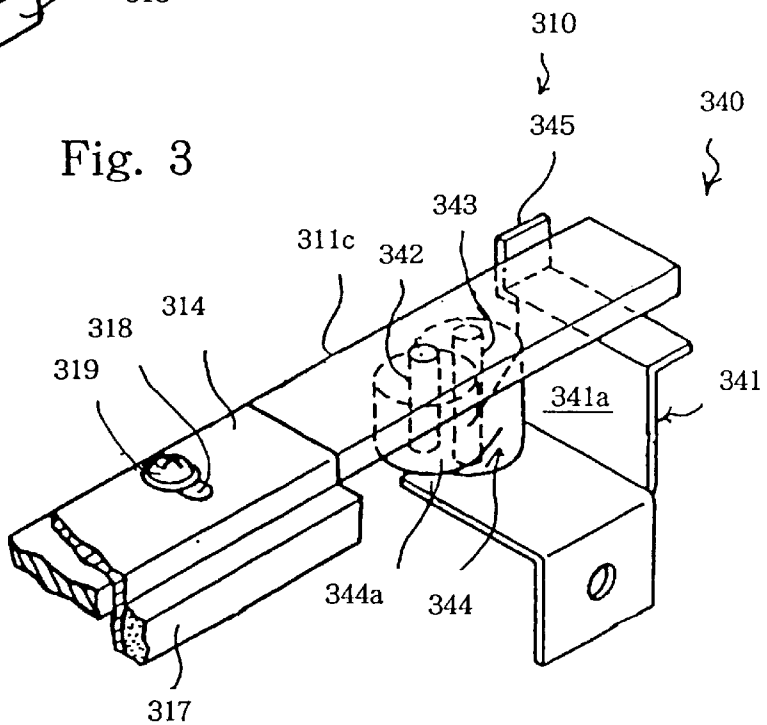
FIG. 4 is a perspective view showing the other end portion of the shank stopper.

Though not shown in the drawings, the shank stopper 310 is supported by the action brackets. FIGS. 3 and 4 show connectors 320/340 provided between the action brackets and the base rail 311. The connector 320 includes a bracket 321, and the bracket 321 is fixed to the action bracket. The bracket 321 is broken down into a base portion 322, an L-letter shaped guide portion 323, another L-letter shaped connecting portion 324 and a U-letter shaped cover portion 325. The base portion 322 provided a flat upper surface, and the L-letter shaped guide portion 323 upwardly projects from one of the side lines of the base portion 322, and the short portion 311*b* of the rail base 311 is moved over the guide portion 323. A stopper 326 is attached to the rear end of the guide portion 323, and sets a limit on the movement of the short portion 311*b.* The other L-letter shaped connecting portion 324 downwardly projects from the front end line of the base portion 322, and the U-letter shaped cover portion 325 is attached to the L-letter shaped connecting portion 324.

The connector 320 further includes a lever, pins 328/329/330 and a pulley 331. The pin 328 is fixed to the flat surface of the base portion 322, and upwardly projects therefrom. The pin 328 is rotatably received in a hole formed in the lever 327 so that the lever 327 turns around the pin 328. The pin 329 is fixed to the short portion 311*b,* and downwardly projects therefrom. The pin 329 is inserted into another hole formed in the lever 327, and the pin 329 is rotatable in the hole. The pin 329 is spaced from the pin 328. The pin 330 is fixed to the lever 327, and downwardly projects from the lever 327. The pin 330 is further spaced from the pin 328. The pulley 331 is rotatably supported by the U-letter shaped portion 325, and directs a wire 351 of the change-over mechanism 350 toward the pin 330. The wire 351 is fixed to the pin 330. When the wire 351 is pulled, the lever 327 turns around the pin 328, and the other pin 329 takes up the rotation of the lever 327.

The other connector 340 includes a bracket 341, pins 342/343 and a lever 344. The bracket 341 is fixed to another action bracket, and a stopper 345 upwardly projects from the bracket 341. The pin 342 is fixed to the long portion 311*c,* and downwardly projects therefrom. On the other hand, the pin 343 is fixed to the bracket 341, and upwardly projects therefrom. Holes are formed in the lever 344, and the pins 342/343 are inserted into the holes, respectively. The relative position between the pins 342 and 343 is identical with the relative position between the pins 329 and 328. The pins 328/329, the rail base 311 and the pins 342/343 form a parallel link mechanism, and the absorbers 315/316/317 are moved substantially in the fore-and-aft direction of the acoustic piano 100. While the rail base 311 is being held in contact with the stoppers 326/345, the shank stopper 310 is resting in the free position. On the other hand, when the wire 351 is pulled, convex portions 327*a*/344*a* are brought into contact with a vertical walls 323*a*/341*a* of the guide portions 323/341, and the shank stopper 310 enters the blocking position.

FIG. 5 illustrates the change-over mechanism 350. The change-over mechanism 350 includes a silent pedal 352 turnable around a pin 353, a hock projecting from the silent pedal 352, a connector 355 connected between the hock 354 and the wire 351, a guide tube 356 and a bracket 357. A slot 180*a* is formed in the bottom sill 180 of the piano housing, and the silent pedal 352 project from the inside of the piano housing through the slot 180*a*. The connector 355 has a connecting block 355*a* and a ring 355*b,* and the wire 351 is fixed to the connecting block 355*a*. The ring 355*b* is also fixed to the connecting block 355*a,* and the hock 354 is engaged with the ring 355*b*. The wire 351 passes through the guide tube 356, and is moved along the guide tube 356. A hole 172*a* is formed in the key bed 172, and the guide tube 356 passes through the hole 172*a*. The bracket 357 is attached to the lower surface of the key bed 172, and the lower end of the guide tube 356 is fixed to the bracket 357. The guide tube 356 upwardly projects from the key bed 172, and the upper end of the guide tube 356 reaches under the pulley 331. Though not shown in FIG. 5, a ratchet mechanism is provided for the silent pedal 352, and a spring is provided between the bracket 321 and the lever 327 so as to urge the lever in the clockwise direction in FIG. 3.

When the player steps on the silent pedal 352, the pedal 352 downwardly pulls the wire 351, and the ratchet mechanism keeps the silent pedal 352 depressed, The wire 351 changes the shank stopper 310 to the blocking position as described hereinbefore, If the player steps on the silent pedal 352, again, the ratchet mechanism releases the silent pedal 352, and the spring urges the lever 327 to turn in the clockwise direction. As a result, the wire 351 upwardly pulls the silent pedal 352, and the silent pedal 352 returns to the initial position.

Figure 6:
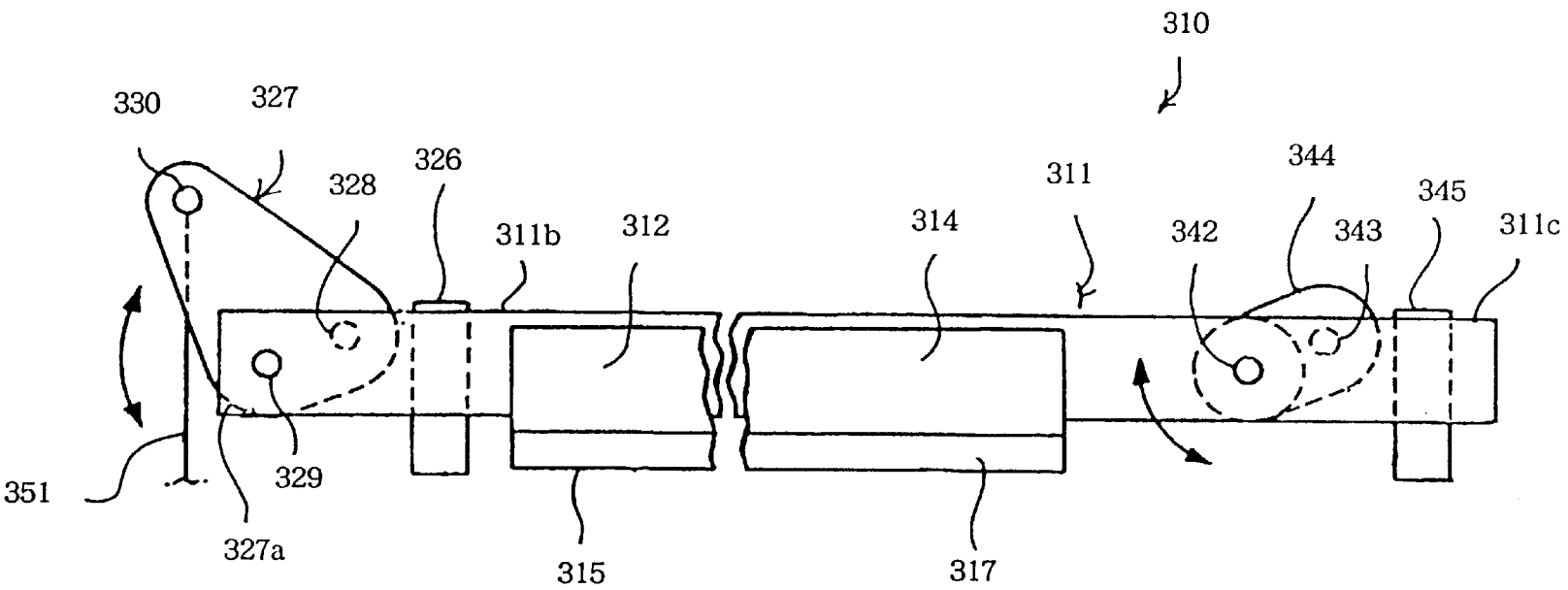
FIG. 6 is a plane view showing the shank stopper in the free position.
Figure 7:
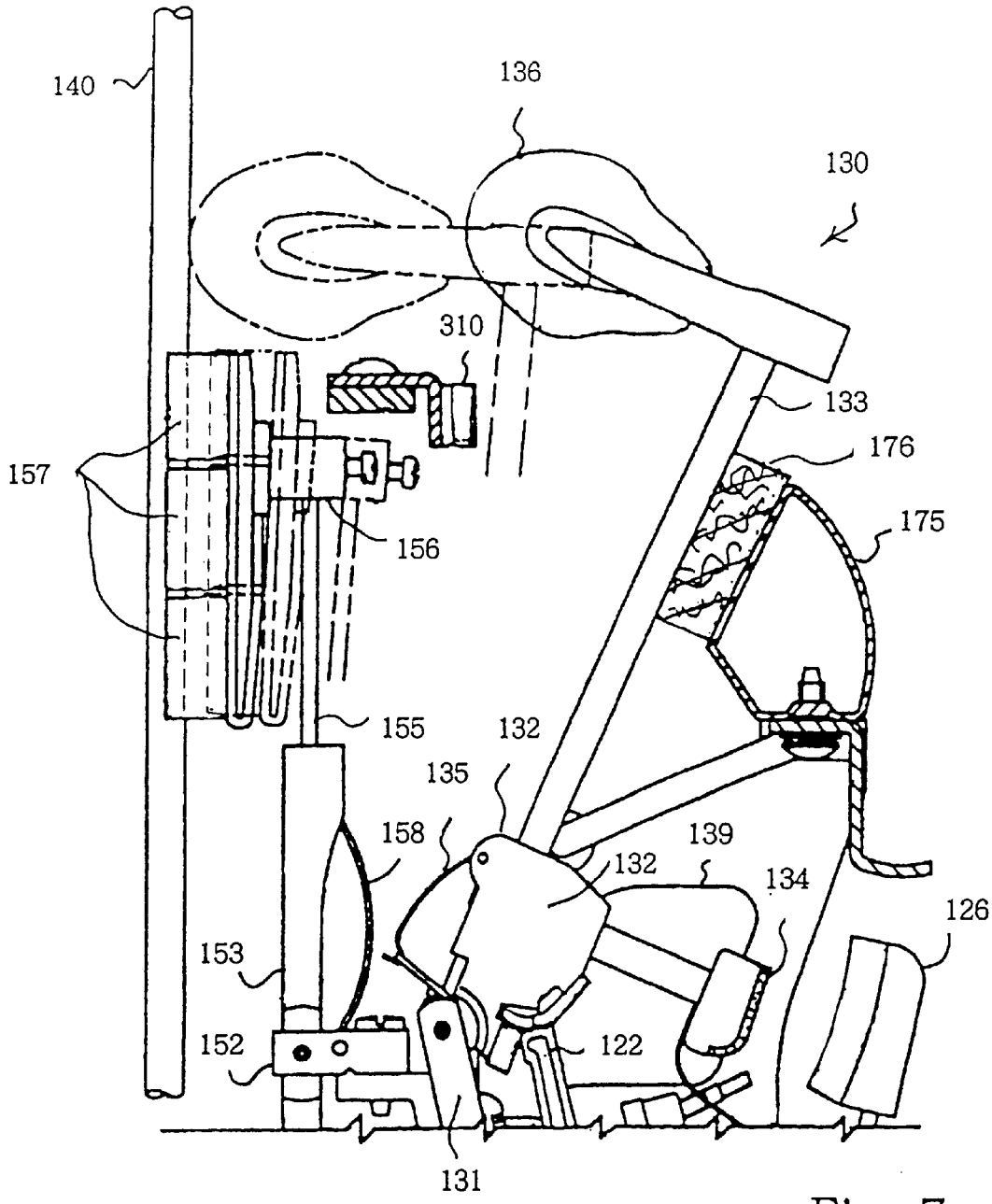
FIG. 7 is a side view showing relative relation between a damper head, a hammer assembly and the shank stopper in the free position.

The keyboard musical instrument behaves as follows. Assuming now that a player wishes to play a tune on the acoustic piano 100. The silent pedal 352 is resting in the initial position, and the rail base 311 are held in contact with the stoppers 326 and 345 as shown in FIG. 6. The absorbers 315/316/317. are retracted, and the shank stopper 310 is staying in the free position. The shank stopper 310 is out of the trajectories of the hammer shanks 133, and, accordingly, allows the hammers 136 to strike the associated sets of strings 140 as shown in FIG. 7.

While the player is playing the tune on the acoustic piano 100, he is assumed to depress the key shown in FIG. 1. The capstan button 112 upwardly pushes the whippen 121, and the whippen assembly 129 turns around the whippen flange 123 in the counter clockwise direction without any relative rotation between the whippen 121 and the jack 122. The jack 122 pushes the butt 132, and gives rise to a rotation around the butt flange 131. The whippen 121 inclines the damper spoon 151, and the damper spoon 151 pushes the lower portion of the damper lever 153. The inclination of the damper spoon 151 gives rise to a rotation of the damper lever 153 around the damper flange 152 in the clockwise direction against the elastic force of the damper spring 158. The damper lever 153 spaces the damper head 156/157 from the associated set of strings 140. Although the shank stopper 310 is in the free position, the damper wood 156 is not brought into contact with the shank stopper 310 as will be seen in FIG. 7. Thus, the set of strings 140 gets ready for vibrations.

The capstan button 112 further pushes up the whippen 121, and the whippen assembly 129 is continued to turn around the whippen flange 123 in the counter clockwise direction. The tow 122*a* is brought into contact with the regulating button 125. The regulating button 125 restricts the tow 122*a,* and the jack 122 quickly turns around the jack flange 124 in the clockwise direction against the elastic force of the jack spring 128. Then, the jack 122 slides on the butt under skin 138, and escapes from the butt 132.

Upon escaping from the butt 132, the hammer assembly 130 starts a free rotation. The hammer 136 strikes the set of strings 140. The set of strings 140 vibrates so as to generate the acoustic sound. The hammer assembly 130 rebounds on the set of strings 140, and the catcher 134 is brought into contact with the back check assembly 126. The bridle tape 139 does not allow the hammer 136 to strike the strings 140, again.

The player releases the key 111, and the key 111 returns toward the rest position. The self-weight of the whippen assembly 129 gives rise to a rotation around the whippen flange 123 in the clockwise direction, The damper spring 158 urges the damper lever 153 in the counter clockwise direction, and the damper felts 157 are brought into contact with the set of strings 140. The damper felts 157 take up the vibrations of the strings 140. The tow 122*a* is left from the regulating button 125, and the jack spring 128 causes the jack 122 to be held in contact with the butt under skin 138, again.

Figure 8:
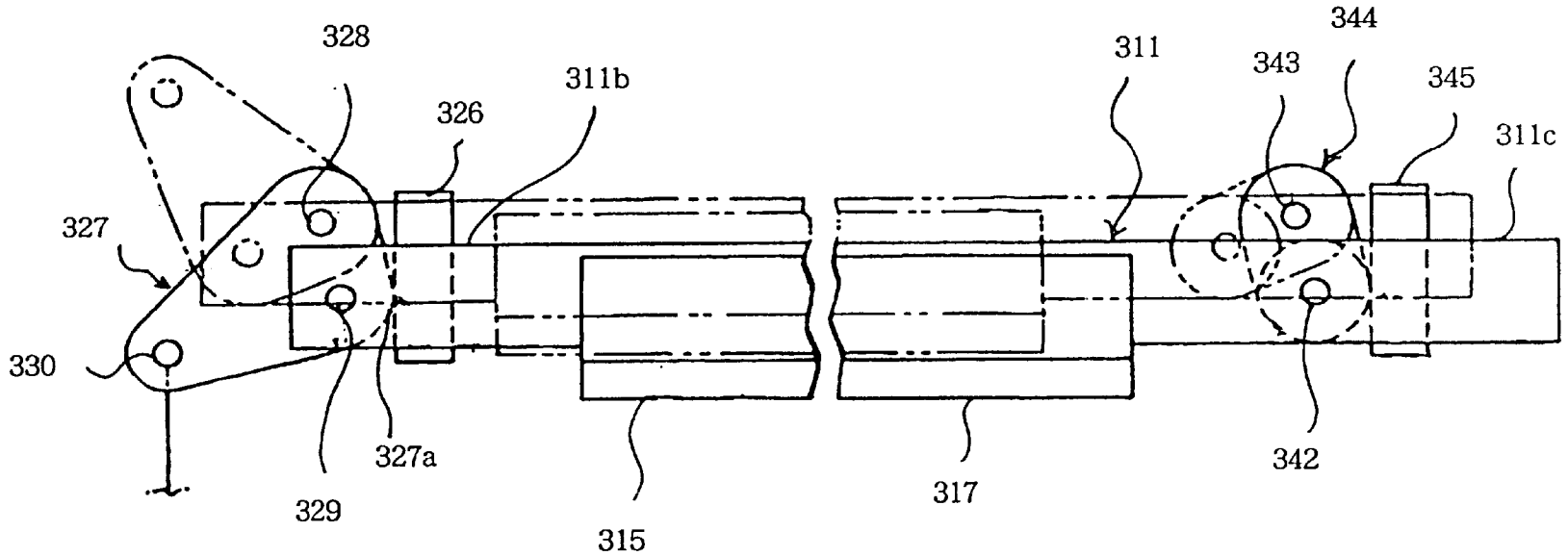
FIG. 8 is a plane view showing the shank stopper in the blocking position.
Figure 9:
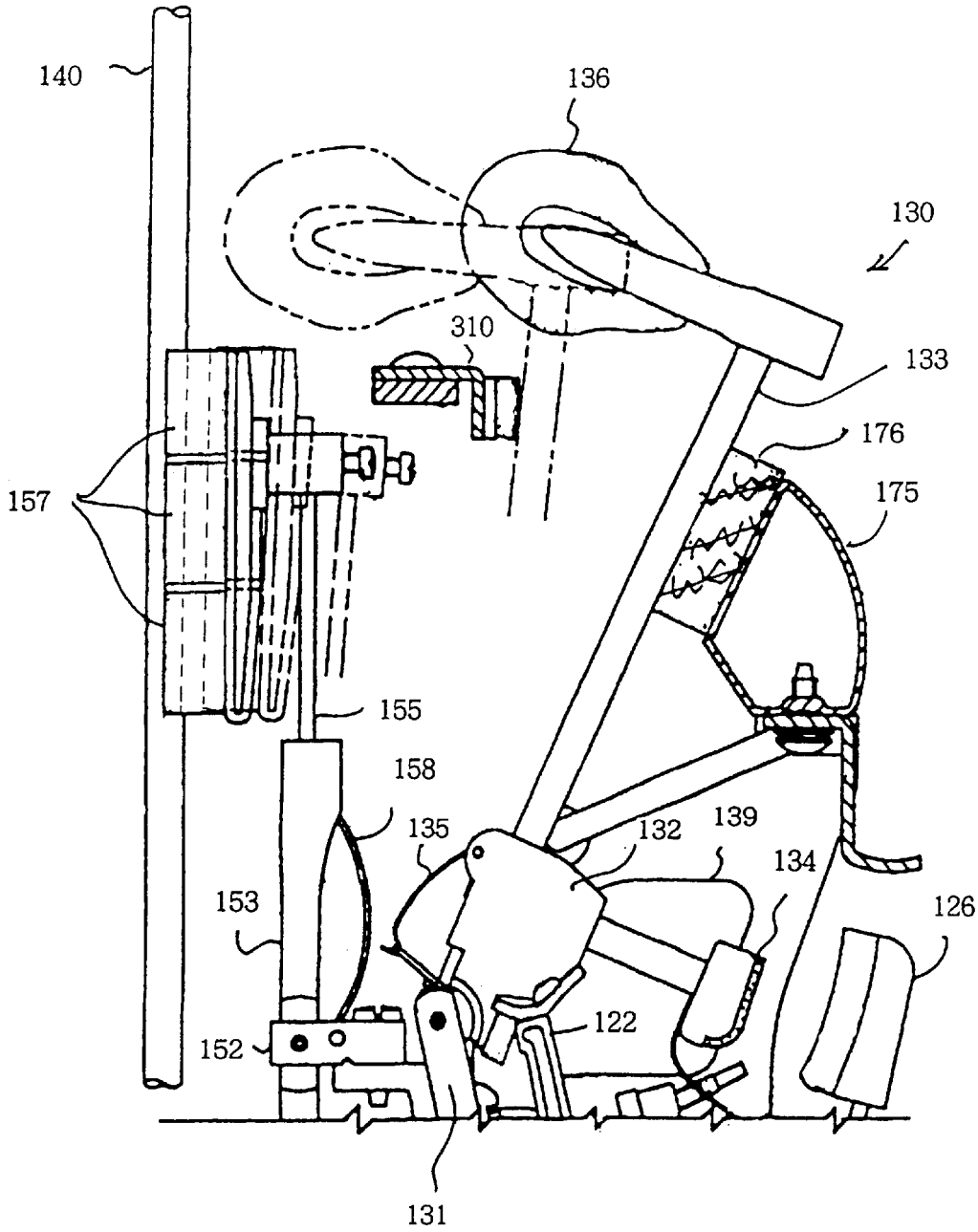
FIG. 9 is a side view showing relative relation between the damper head, the hammer assembly and the shank stopper in the blocking position.

The player is assumed to request the keyboard musical instrument to generate electronic sounds instead of the acoustic sounds. The player steps on the silent pedal 352 (see FIG. 5), and the wire 351 is pulled down. The levers 327/344 turn around the pins 328/343 in the clockwise direction, and the convex portions 327*a*/344*a* are brought into contact with the vertical walls 323*a*/341*a,* respectively, (see FIG. 8). The rail base 311, the stopper rail segments 312/313/314 and the absorbers 315/316/317 turn around the pins 328/343 together with the levers 327/344. The rail base 311, the stopper rail segments 312/313/314 and the absorbers 315/316/317 are moved on a virtual plane substantially parallel to the key bed 172, and the absorbers 315/316/317 project toward the hammer shanks 133. Thus, the shank stopper 310 enters into the blocking position, The absorbers 315/316/317 are on the trajectories of the hammer shanks 133, and the hammer shanks 133 rebound on the absorbers 315/316/317 before striking the strings 140 as shown in FIG. 9.

The player is assumed to depress the key 111. The damper mechanism 150 similarly behaves. The key action mechanism 120 and the hammer assembly 130 similarly behaves until the jack 122 escapes from the butt 132, and description is omitted for the sake of simplicity.

The hammer assembly 130 starts the free rotation at the escape. However, the hammer shank 133 rebounds on the shank stopper 310 before the hammer 136 strikes the set of strings 140 as drawn by using dots-and-dash line in FIG. 9. The hammer assembly 130 and the key action mechanism 120 return to the initial positions as similar to those described hereinbefore.

As will be understood from the foregoing description, the shank stopper 310 horizontally projects into the trajectories of the hammer shanks 133, and is horizontally retracted therefrom. The horizontal motion prevents the rail base 311 from the undesirable twist. Although the change-over mechanism 350 is connected to the lever 327 located at one end of the rail base 311, the rail base 311 is not substantially twisted, and the shank stopper 310 exactly enters into the blocking position. Thus, the shank stopper 310 is simple and reliable.

Figure 10:
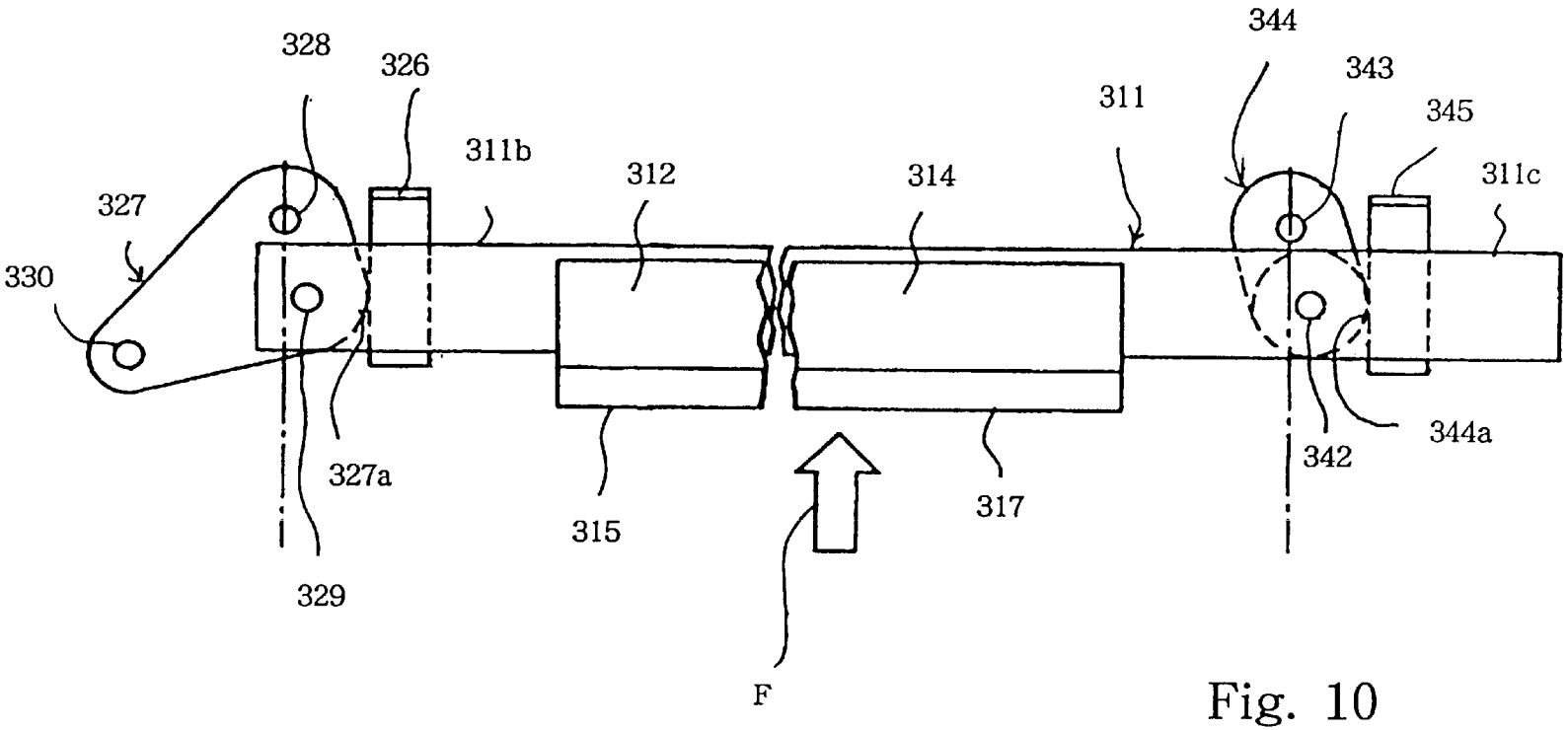
FIG. 10 is a plane view illustrating why the shank stopper is unintentionally changed to the free position.

While the shank stopper 310 is resting in the free position, the pins 329/342 are closer to the hammer shanks 133 and outside of the pins 328/343. When the shank stopper 310 is changed from the free position to the blocking position, the pins 329/342 are changed to the positions also closer to the hammer shanks 133 but inside of the pins 328/343. In this situation, if the hammer shank 133 rebounds on the absorber 315/316/317, force F is exerted on the pins 329/342 (see FIG. 10), and generate moments around the pins 328/343 in the counter clockwise direction. When the player wishes to change the shank stopper 310 to the free position, the change-over mechanism 350 gives rise to moments in the clockwise direction. Thus, the moments due to the force F are opposite to the moments to be required for changing it to the free position. The lateral component forces of the moments are exerted on the vertical walls 323*a*/341*a,* and the pins 328/343 receive the component forces of the moments in the fore-and-aft direction. The vertical walls 323*a*/341*a* do not allow the levers 327/344 to further turn in the counter clockwise direction. Thus, the shank stopper 310 is never unintentionally changed to the free position due to the impact against the absorbers 315/316/317. The vibrations due to the impact are propagated to the connectors 320/340, and the vibrations are never left in the levers 327/344.

In the above-described embodiment, the pins 328/329 and 342/343 and the levers 327/344 as a whole constitute two members Although the particular embodiment of the present invention has been shown and described, it will be apparent to those skilled in the art that various changes and modifications may be made without departing from the spirit and scope of the present invention.

The acoustic piano may be a grand piano. The silent system 300 may be incorporated in another kind of keyboard musical instrument such as, for example, automatic player piano.

Figure 2:
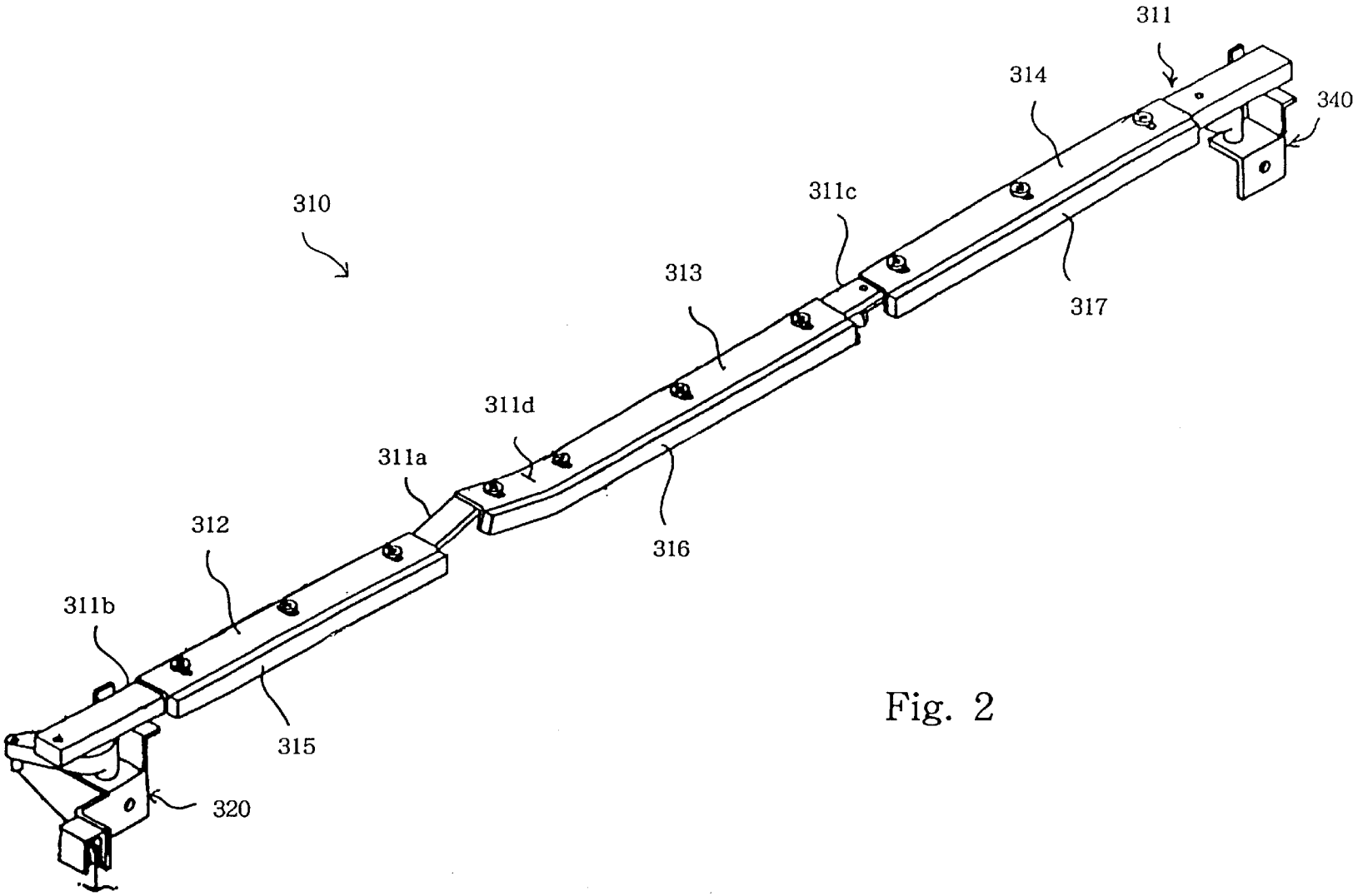
FIG. 2 is a perspective view showing a shank stopper incorporated in the keyboard musical instrument.

The rail base 311 is never limited to the configuration shown in FIG. 2 in so far as the rail base does not interfere the damper mechanisms 150, the strings 140 and the key action mechanisms 120. A shank stopper may have more than or less than three stopper rail segments. Cushions may be attached to the stoppers 326/345.

The change-over mechanism may be manipulated by a hand. Otherwise, an actuator such as, for example, an electric motor may be connected to the pin 329 fixed to the lever 327.

What is claimed is:

1. A keyboard musical instrument having a lateral direction, a fore-and-aft direction perpendicular to said lateral direction and a vertical direction perpendicular to the horizontal plane defined by said lateral direction and said fore-and-aft direction, comprising:

a keyboard having plural keys arranged in said lateral direction, and assigned notes of a scale, respectively;

plural music strings for generating acoustic tones of said notes, respectively;

plural hammers respectively linked with said plural keys for striking said plural music strings, respectively; and a silent system including a hammer stopper selectively entering a free position where said plural hammers are allowed to strike the associated music strings and a blocking position where said hammers rebound thereon before striking said associated music strings and a change-over means connected to said hammer stopper so as to change said hammer stopper between said free position and said blocking position, said hammer stopper including two members spaced apart from one another in said lateral direction and respectively having vertical axes of rotation extending in said vertical direction at first end portions thereof, absorbing means where said hammers rebound and a movable member supporting said absorbing means and connected to second end portions of said two members spaced from said first end portions so that said change-over means gives rise to a parallel motion of said absorbing means in said fore-and-aft direction on said horizontal plane through a rotation of said movable member around said axes of rotation.

2. The keyboard musical instrument as set forth in claim 1, in which each of said two members includes a first pin connected to a stationary member and having one of said vertical axes, a second pin connected to said movable member and a lever connected at the first end portion to said first pin and at the second end portion to said second pin.

3. The keyboard musical instrument as set forth in claim 2, in which said second pin of each of said two members is positioned on one side with respect to the associated first pin while said hammer stopper is resting in said free position, the second pins of said two members are changed to the other sides with respect to the first pins when said hammer stopper is changed to said blocking positions through a first rotation of said two members, and a force exerted on said hammer stopper at the rebound gives rise to said first rotation.

4. The keyboard musical instrument as set forth in claim 3, in which said two members are respectively brought into contact with first stoppers when said hammer stopper enters said blocking position.

5. The keyboard musical instrument as set forth in claim 3, in which said two members are respectively brought into contact with first stoppers when said hammer stopper enters said free position.

6. The keyboard musical instrument as set forth in claim 3, in which said two members are respectively brought into contact with first stoppers when said hammer stopper enters said blocking position, and said two members are respectively brought into contact with second stoppers when said hammer stopper enters said blocking position.

7. The keyboard musical instrument as set forth in claim 1, in which said absorbing means has plural absorbers attached to said movable member at intervals.

8. The keyboard musical instrument as set forth in claim 7, in which said movable member includes a rail base and stopper rail brackets connected between said rail base and said absorbers.

9. The keyboard musical instrument as set forth in claim 8, in which said stopper rail brackets are independently projectable and retractable with respect to said rail base.

10. The keyboard musical instrument as set forth in claim 1, further comprising plural key action mechanisms respectively provided between said plural keys and said plural hammers and giving rise to rotations of said plural hammers when a player selectively depresses said plural keys.

11. The keyboard musical instrument as set forth in claim 10, further comprising an electronic sound generating system monitoring said keyboard to see what key is depressed by said player for selectively generating electronic sounds.

* * * * *